United States Patent [19]

Inomata et al.

[11] 4,368,447

[45] Jan. 11, 1983

[54] ROLLED CORE

[75] Inventors: Koichiro Inomata, Yokohama; Michio Hasegawa, Machida, both of Japan

[73] Assignee: Tokyo Shibaura Denki Kabushiki Kaisha, Kawasaki, Japan

[21] Appl. No.: 250,549

[22] Filed: Apr. 3, 1981

[30] Foreign Application Priority Data

Apr. 30, 1980 [JP] Japan ..... 55-56176

[51] Int. Cl.[3] ..... H01F 21/02

[52] U.S. Cl. ..... 336/20; 148/31.55; 336/213; 336/233; 428/687

[58] Field of Search ..... 148/31.55, 101, 104, 148/120, 121; 428/928, 687; 75/123 K, 124 E, 124 F, 170; 336/213, 233, 20

[56] References Cited

U.S. PATENT DOCUMENTS

| | | | |
|---|---|---|---|
| 4,053,331 | 10/1977 | Graham et al. | 148/120 |
| 4,187,128 | 2/1980 | Billings et al. | 148/121 |
| 4,227,120 | 10/1980 | Luborsky | 148/31.55 |
| 4,249,969 | 2/1981 | DeCristofaro et al. | 148/108 |
| 4,298,409 | 11/1981 | DeCristofaro et al. | 148/108 |
| 4,307,771 | 12/1981 | Draizen et al. | 164/463 |
| 4,314,594 | 2/1982 | Pfeifer et al. | 148/108 |

FOREIGN PATENT DOCUMENTS 51-65395 5/1976 Japan .

OTHER PUBLICATIONS

O'Handley, R. C., Magnetostriction of Ferromagnetic Metallic Glasses, Solid State Communications, vol. 21, pp. 1119–1122, 1977.

Egami, T. et al., Low-Field Magnetic Properties of Ferromagnetic Amorphous Alloys, Applied Physics Letters, vol. 26, No. 3, Feb. 1, 1975, pp. 128–130.

O'Handley, R. C. et al., Low-Field Magnetic Properties of $Fe_{80}B_{20}$ Glasses, Journal of Applied Physics, vol. 27, No. 10, Oct. 1976, pp. 4660–4662.

*Primary Examiner*—John P. Sheehan

*Attorney, Agent, or Firm*—Oblon, Fisher, Spivak, McClelland & Maier

[57] ABSTRACT

A rolled core is formed by winding a thin body of an amorphous magnetic alloy having positive magnetostriction characteristics so that, of the two surfaces the surface of smaller surface coarseness faces inward. This rolled core is improved in iron loss over a rolled core obtained by winding the thin body so that the surface of greater surface coarseness faces inward. Breakage of the thin body tends to occur less frequently when it is wound so that the surface faces inward.

3 Claims, 5 Drawing Figures

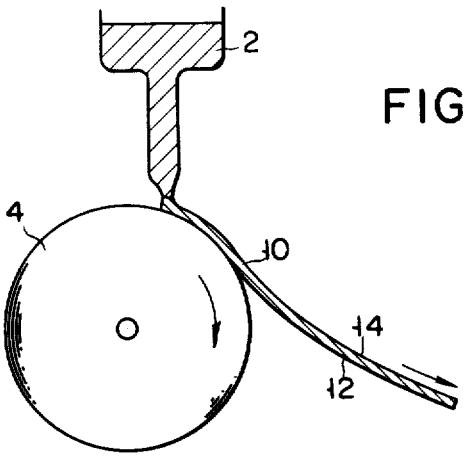
FIG. 1
FIG. 2
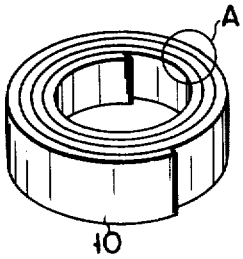
FIG. 3
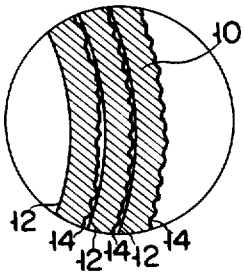
FIG. 4
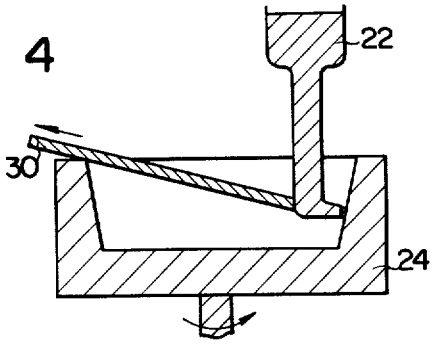

ROLLED CORE

The present invention relates to a rolled core formed by winding a thin body of an amorphous magnetic alloy.

Rolled cores are used for electromagnetic devices such as power transformers, high frequency transformers, and magnetic shields, and are annular electromagnetic parts formed by winding thin bodies of magnetic material.

Conventional rolled cores have been made of crystalline magnetic materials such as Fe-Si alloys and Fe-Ni alloys. However, they have a defect of large iron loss which particularly makes the rolled core practically unusable within high frequency ranges. Amorphous magnetic alloys of small iron loss have recently been proposed which are obtained by rapidly cooling the molten alloys.

These amorphous magnetic alloys are prepared by the melt spinning method which includes the single roller method and the centrifugal rapid cooling method. The amorphous magnetic alloys obtained in this manner have surfaces (contact surface) which were brought into contact with the cooling medium and surfaces (free surface) which were not brought into contact therewith. Thus, they have so-called a front surface and a rear surface. It is different from the crystalline magnetic alloy thin bodies of Fe-Si system and Fe-Ni system which are prepared by the conventional rolling method. Since these alloy thin bodies are prepared by rolling, they do not have a front surface and a rear surface. The front and rear surfaces of the amorphous magnetic alloy thin bodies are generally of different surface coarseness; the surface coarseness of the free surface is greater than that of the contact surface. The amorphous alloy which is prepared by sufficiently rapid cooling is mechanically very strong. However, when the cooling is not sufficient, the strength of the amorphous alloy is not sufficient, and care must be taken to avoid breakage during the winding process. In particular, in the mass-production of the amorphous alloys, some parts of the amorphous alloys are not cooled sufficiently, resulting in parts which are relatively weak in mechanical strength.

An object of the present invention is to provide a rolled core made of an amorphous magnetic alloy thin body which has small iron loss and which is easy to wind up.

The present inventors now have found that a rolled core with small iron loss and less breakage may be obtained by winding a thin body of an amorphous magnetic alloy having positive magnetostriction characteristics in such fashion that the surface of smaller surface coarseness faces inward. Considering the fact that the method of winding the thin bodies of amorphous magnetic alloys has not been considered to influence the breakage of the thin body or the iron loss of the rolled core, the discovery may be deemed remarkable.

The present invention provides a rolled core formed by winding a thin body of an amorphous magnetic alloy having positive magnetostriction characteristics in such a way that, of the two surfaces, the surface of smaller surface coarseness faces inward.

With respect to elimination of iron loss and breakage during winding, the rolled core of the present invention is significantly improved over a rolled core in which the surface having larger surface coarseness faces inward.

This invention can be more fully understood from the following detailed description when taken in conjunction with the accompanying drawings, in which:

FIG. 1 is a schematic sectional view illustrating a method for preparing a thin body of an amorphous magnetic alloy;

FIG. 2 is a perspective view of a rolled core according to the present invention;

FIG. 3 is an enlarged plan view of part A of the rolled core shown in FIG. 2;

FIG. 4 is a schematic sectional view illustrating another method for preparing a thin body of an amorphous magnetic alloy.

Figure 5:
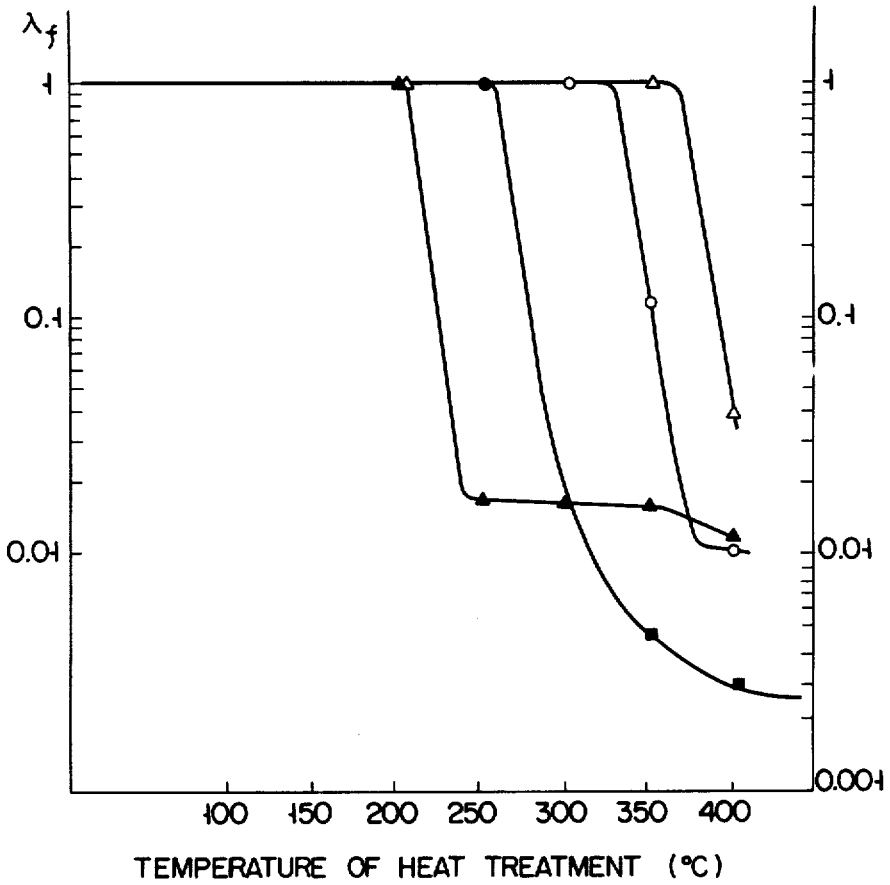
FIG. 5 is a graph showing the results of a bending test of the thin bodies of the amorphous magnetic alloys.

A thin body of an amorphous magnetic alloy is prepared by rapidly cooling the molten raw alloy material. For example, a molten raw material 2 is ejected from a nozzle onto a cooled rotary roller 4 rotating at a high speed to be rapidly cooled at a rate of $10^{5°}$ to $10^{6°}$ C./sec for providing a thin body 10 of an amorphous magnetic alloy. This thin body 10 has two surfaces, a contact surface 12 which has been brought into contact with the rotary roller 4, and a free surface 14 which has not been brought into contact with the rotary roller 4. The surface coarseness of the contact surface 12 is determined by the surface precision of the rotary roller 4. Since a rotary roller of about 0.1 μm in surface precision is used in practice, the contact surface 12 will have a smaller surface coarseness than the free surface 14.

When a thin body of the amorphous magnetic alloy is prepared by passing the molten raw material between two cooled rotary rollers, it is possible to prepare a thin body having two surfaces of different surface coarseness by varying the surface precisions of the two rotary rollers.

A rolled core as shown in FIG. 2 is obtained by winding this thin body 10 of the amorphous magnetic alloy. When winding the thin body 10, as shown in FIG. 3, the surface of smaller surface coarseness, that is, the contact surface 12, must face inward and the surface with greater surface coarseness, that is, the free surface 14, must face outward.

In order to obtain the effects of the present invention, the amorphous magnetic alloy must be one which has positive magnetostriction characteristics. As such an amorphous magnetic alloy, Fe system or Fe-Ni system alloys are known which have the following general formula:

$$(Fe_{1-x-y}Co_yNi_x)_{1-a}X_a$$

wherein X is at least one element selected from the group consisting of P, B, C, Si, Ge, and Al; $0.15 \leqq a \leqq 0.35$; $0 \leqq x \leqq 0.7$, and $0 \leqq y \leqq 0.9$.

A magnetic alloy which is amorphous may be obtained by including at least one element selected from P, B, C, Si, Ge, and Al; and the amorphous property may be more easily obtained by including these elements in an amount of 15 to 35 atomic%. By including Ni, the iron loss of the resultant alloy may be made smaller and the corrosion resistance may be improved. However, when the amount of the Ni exceeds 70 atomic%, the Curie temperature becomes less than room temperature, providing an impractical alloy. By including Co, the iron loss of the alloy may be made smaller. However, when its amount exceeds 90 atomic%, the magnetostriction becomes negative and is not appropriate for the present invention.

The rolled core of the present invention exhibits extremely good soft magnetic characteristics. With the rolled core obtained by winding a thin body of amorphous magnetic alloy having positive magnetostriction characteristics with the surface of smaller coarseness facing inward, the iron loss may be improved by 10 to 40% over the rolled core obtained by winding the thin body with the surface of greater coarseness facing inward. It has been conventionally assumed that the iron loss stays the same, regardless of which of the surfaces faces inward for winding. Considering this, the improvements in the iron loss obtained by the present invention are remarkable.

Although the precise reason why the iron loss is improved according to the present invention is not clear, the following is surmised. A smaller iron loss may be obtained when the anisotropy represented by the product of the stress and the magnetostriction which is a factor for determining the iron loss is small. The magnetostriction is determined as an inherent value of the material. Since the magnetostriction is not generally zero, the presence of the stress together with the magnetostriction results in the anisotropy. With a material having positive magnetostriction characteristics, it is considered that the magnetic characteristics are degraded and the iron loss increases when a compressive force is exerted. When this is explained with particular reference to the present invention, by winding a thin body of a magnetic alloy with the surface of smaller surface coarseness facing inward and the surface of greater surface coarseness facing outward, the compressive force exerted on the inside becomes smaller than in the case where the thin body is wound with the surface of greater surface coarseness facing inward. As a result of this, it is considered that the anisotropy caused by the stress becomes smaller, thus making the iron loss smaller.

In the manufacture of the rolled core, when the thin body of the amorphous magnetic alloy is wound with the surface of smaller surface coarseness facing inward, damage or breakage of the thin body may be eliminated and the rolled core may be manufactured with ease and certainty. On the other hand, when the thin body is wound with the surface of greater surface coarseness facing inward, damage and breakage of the thin body tend to occur. A bending test of the thin bodies of amorphous alloys will be described in Example 3.

The present invention will now be described in more detail by way of its examples.

EXAMPLE 1

Various thin bodies of amorphous magnetic alloys with positive magnetostriction characteristics were manufactured by the method shown in FIG. 1. The diameter of the roller 4 was 200 mm, and the rotational frequency was 4,000 r.p.m. The shape of the resultant thin body 10 was an elongated tape which was 2 mm in width and about 30 μm in thickness. The surface 12 of this thin body 10 which was brought into contact with the roller 4 had a coarseness of about ±2 μm, and the free surface 14 had a coarseness of about ±7 μm and a superior gloss to that of the surface 12. Two samples 140 cm in length were cut out from the thin body 10, and they were wound around alumina bobbins of 20 mm diameter, one with the free surface 14 facing outward and the other with the free surface 14 facing inward, to provide rolled cores. Since the amorphous magnetic alloys have great internal stress after they are prepared, they generally have great iron loss. For obtaining an amorphous magnetic alloy with small iron loss, it is necessary to perform a heat treatment to remove the internal stress. The heat treatment is preferably performed at a temperature which is above the Curie temperature (Tc) and below the crystallizing temperature (Tx). Both rolled cores were annealed for 30 minutes in a vacuum at a temperature which was below the crystallizing temperature and above the Curie temperature. Primary and secondary windings were wound on the respective rolled cores for 70 turns, respectively. The iron loss was then measured using a wattmeter. The results are shown in Table 1 below together with the Curie temperature (Tc) and the crystallizing temperature (Tx).

TABLE 1

| | Amorphous magnetic alloy composition | Iron loss (mW/cm³) at 3 kG magnetic flux density (Bm) | | | | | | | |
|---|---|---|---|---|---|---|---|---|---|
| | | Coil with free surface facing outward | | | Coil with free surface facing inward | | | | |
| | | 100 Hz | 1 kHz | 10 kHz | 100 Hz | 1 kHz | 10 kHz | Tc(°C.) | Tx(°C.) |
| 1 | $Fe_{78}Si_8B_{14}$ | 1.1 | 30 | 550 | 1.7 | 50 | 650 | 450 | 530 |
| 2 | $(Fe_{0.8}Ni_{0.2})_{78}$ $Si_8B_{14}$ | 0.85 | 15 | 270 | 1.3 | 22 | 300 | 420 | 505 |
| 3 | $(Fe_{0.5}Ni_{0.5})_{78}$ $Si_8B_{14}$ | 0.43 | 5 | 125 | 0.64 | 7 | 140 | 350 | 485 |
| 4 | $(Fe_{0.3}Ni_{0.7})_{75}$ $Si_8B_{14}$ | 0.40 | 4 | 110 | 0.60 | 6 | 120 | 160 | 480 |
| 5 | $(Fe_{0.9}Co_{0.1})_{75}$ $Si_{15}B_{10}$ | 0.61 | 25 | 500 | 0.91 | 45 | 600 | 480 | 520 |
| 6 | $(Fe_{0.2}Co_{0.8})_{75}$ $Si_{10}B_{15}$ | 0.83 | 20 | 440 | 1.24 | 35 | 480 | 420 | 490 |
| 7 | $(Fe_{0.4}Ni_{0.5}Co_{0.1})_{80}$ $Si_{10}B_{10}$ | 0.37 | 4 | 100 | 0.55 | 6 | 110 | 370 | 430 |
| 8 | $Fe_{81}C_2Si_2B_{15}$ | 1.2 | 28 | 600 | 1.75 | 50 | 710 | 380 | 490 |
| 9 | $(Fe_{0.5}Ni_{0.5})_{78}$ $Si_8C_2B_{12}$ | 0.45 | 5 | 135 | 0.67 | 7 | 155 | 340 | 480 |
| 10 | $(Fe_{0.5}Ni_{0.5})_{78}$ $Ge_2C_6B_{14}$ | 0.46 | 5 | 140 | 0.65 | 8 | 160 | 320 | 420 |
| 11 | $(Fe_{0.5}Ni_{0.5})_{78}$ $P_{14}B_6Al_2$ | 0.48 | 5 | 140 | 0.72 | 8 | 160 | 310 | 430 |
| 12 | $Fe_{80}B_{20}$ | 1.3 | 32 | 650 | 1.94 | 55 | 770 | 375 | 420 |

As may be apparent from Table 1, the rolled core with the free surface facing outward showes a smaller iron loss and improves soft magnetic characteristics in comparison with the rolled core with the free surface facing inward. This tendency becomes more pronounced as the frequency becomes greater.

EXAMPLE 2

Thin bodies of the amorphous alloys with positive magnetostriction were manufactured by the centrifugal rapid cooling method as shown in FIG. 4. A cylinder 24 as a solid cooling medium had a 300 mm inner diameter and was rotated at a rotational frequency of 1,500 r.p.m. Molten raw materials 22 were injected toward the inner wall of the cylinder 24 to be rapidly cooled thereby for providing thin bodies 30 of the amorphous magnetic alloys. In these thin bodies 30, the surfaces which were brought into contact with the cylinder 24 had smaller surface coarseness and inferior gloss, and the free surfaces had greater surface coarseness and improved gloss. Rolled cores were manufactured from these thin bodies in the manner similar to that in Example 1. The iron loss was evaluated as in Example 1, and the results are shown in Table 2 below.

TABLE 2

| | Iron loss (mW/cm$^3$) at 3 kG magnetic flux density (Bm) | | | | | |
|---|---|---|---|---|---|---|
| | Coil with free surface facing outward | | | Coil with free surface facing inward | | |
| Amorphous magnetic alloy composition | 100 Hz | 1 kHz | 10 kHz | 100 Hz | 1 kHz | 10 kHz |
| 13 $(Fe_{0.8}Ni_{0.2})_{80}Si_8B_{12}$ | 0.81 | 13 | 250 | 1.21 | 20 | 280 |
| 14 $(Fe_{0.7}Ni_{0.3})_{80}Si_8B_{12}$ | 0.78 | 12 | 240 | 1.16 | 19 | 270 |
| 15 $(Fe_{0.5}Ni_{0.5})_{80}Si_8B_{12}$ | 0.40 | 4 | 110 | 0.60 | 6 | 120 |

EXAMPLE 3

Thin bodies of the two kinds of amorphous magnetic alloys $Fe_{80}B_{20}$ and $Fe_{78}Si_{10}B_{12}$ with positive magnetostriction characteristics were manufactured in a manner similar to that in Example 1. The samples were heat-treated in a vacuum for 30 minutes and were subjected to the bending test. A sample of certain thickness t was bent to a certain radius of curvature. Force was exerted on both ends, and the distance $l_f$ between the two ends when the thin body broke was measured. The breaking strain $\lambda_f$ was obtained from the following equation:

$$\lambda_f = t/(l_f - t)$$

wherein $\lambda_f = 1$ corresponds to the case where $l_f = 2t$ and indicates that the thin body did not break even when it was bent through 180°. FIG. 5 shows the relation between the temperature of the heat treatment and the breaking strain $\lambda_f$. For the thin body of $Fe_{80}B_{20}$, the hollow circle mark o corresponds to a case wherein the thin body was bent with the free surface of greater surface coarseness facing outward, and the solid circle mark • corresponds to a case wherein the free surface was facing inwardly. For the thin body of $Fe_{78}Si_{10}B_{12}$, a hollow triangle mark Δ corresponds to a case wherein the thin body was bent with the free surface facing outward, and the solid triangle mark corresponds to a case wherein the free surface was facing inward. It is seen from FIG. 5 that, for both of the samples, the thin body was more resistant to stress when it was bent with the surface with greater surface coarseness facing outward. When the thin body is heat-treated at a temperature (385° C. for $Fe_{80}B_{20}$ and 360° C. for $(Fe_{0.5}Ni_{0.5})_{78}Si_8B_{14}$) suitable for reducing the iron loss, the value of $\lambda_f$ when the thin body is bent with the surface of greater surface coarseness facing outward is 0.01 for $Fe_{80}B_{20}$ and 1 for $(Fe_{0.5}Ni_{0.5})_{78}Si_8B_{14}$. When the thin body was bent with the surface of greater surface coarseness facing inward, $\lambda_f = 0.003$ for $Fe_{80}B_{20}$ and $\lambda_f = 0.015$ for $(Fe_{0.5}Ni_{0.5})_{78}Si_8B_{14}$. In both cases, the value of $\lambda_f$ is larger by about two orders of magnitude when the surface with greater surface coarseness faces outward. This means that the rolled core of the present invention is strong against breakage.

What we claim is:

1. A rolled core formed by winding a thin body of an amorphous magnetic alloy having positive magnetostriction characteristics, characterized in that said thin body is wound with the surface of smaller surface coarseness of said thin body facing inward.

2. A rolled core according to claim 1, wherein said surface of smaller surface coarseness is a surface which has been brought into contact with a solid cooling medium, and the other surface is a free surface which has not come in contact with the solid cooling medium.

3. A rolled core according to claim 1, wherein said amorphous magnetic alloy having positive magnetostriction characteristics is represented by the general formula:

$$(Fe_{1-x-y}Ni_xCo_y)_{1-a}X_a$$

wherein X is at least one elements selected from the group consisting of P, B, C, Si, Ge, and Al; $0.15 \leq a \leq 0.35$; $0 \leq x \leq 0.7$; and $0 \leq y \leq 0.9$.

* * * * *